US009127634B2

(12) United States Patent
Brandt et al.

(10) Patent No.: US 9,127,634 B2
(45) Date of Patent: Sep. 8, 2015

(54) METHOD FOR DETERMINING THE OPENING POINT IN THE TIME OF A FUEL INJECTOR

(75) Inventors: Martin Brandt, Wörth a.d. Donau (DE); Christian Frankenberger, Regensberg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 327 days.

(21) Appl. No.: 13/879,453

(22) PCT Filed: Oct. 13, 2011

(86) PCT No.: PCT/EP2011/005143

§ 371 (c)(1),
(2), (4) Date: Jun. 3, 2013

(87) PCT Pub. No.: WO2012/048881

PCT Pub. Date: Apr. 19, 2012

(65) Prior Publication Data

US 2014/0012485 A1 Jan. 9, 2014

(30) Foreign Application Priority Data

Oct. 14, 2010 (DE) ..... 10 2010 042 467

(51) Int. Cl.
*F02D 41/30* (2006.01)
*F02M 65/00* (2006.01)
*F02D 41/20* (2006.01)

(52) U.S. Cl.
CPC ..... *F02M 65/005* (2013.01); *F02D 41/20* (2013.01); *F02D 41/3005* (2013.01)

(58) Field of Classification Search
CPC ..... F02D 41/20; F02D 41/26; F02D 41/30; F02D 41/3005; F02M 65/005
USPC ..... 123/472, 478, 480, 482, 488, 490; 701/103, 105; 73/114.45, 114.47, 73/114.49, 114.43, 114.51
See application file for complete search history.

(56) References Cited

U.S. PATENT DOCUMENTS 5,245,501 A 9/1993 Locher et al. ..... 361/154
7,273,038 B2 9/2007 Hayakawa ..... 123/478

(Continued)

FOREIGN PATENT DOCUMENTS

DE 3843138 A1 6/1990 ..... B60T 8/36
DE 10021086 A1 11/2001 ..... F02D 41/20

(Continued)

OTHER PUBLICATIONS

German Office Action, Application No. 10 2010 042 467.6, 5 pages, Aug. 9, 2011.
International Search Report and Written Opinion, Application No. PCT/EP2011/005143, 13 pages, Feb. 24, 2012.

*Primary Examiner* — Hai Huynh
(74) *Attorney, Agent, or Firm* — Slayden Grubert Beard PLLC

(57) ABSTRACT

A method for determining the opening point in time of a control valve having a coil drive of an indirectly driven fuel injector for an internal combustion engine of a motor vehicle may include: detecting the time curve of the current intensity of a current flowing through the coil drive, determining a current integral with respect to the detected current intensity as a function of the time and starting from a defined initial time, and determining a time at which the current integral reaches at least a predefined current integral reference value, wherein the determined time is the opening point in time of the control valve. A corresponding device and a computer program for determining the opening point in time of a control valve of an indirectly driven fuel injector are also disclosed.

16 Claims, 5 Drawing Sheets

(56) References Cited

U.S. PATENT DOCUMENTS

| | | | | |
|---|---|---|---|---|
| 8,599,530 | B2 * | 12/2013 | Onda et al. | 361/152 |
| 2008/0017172 | A1 | 1/2008 | Kojima | 123/478 |
| 2011/0120423 | A1 * | 5/2011 | Borchsenius et al. | 123/494 |
| 2011/0251808 | A1 * | 10/2011 | Serra et al. | 702/64 |
| 2012/0318883 | A1 * | 12/2012 | Kusakabe et al. | 239/1 |
| 2012/0323468 | A1 * | 12/2012 | Miyaura et al. | 701/105 |
| 2014/0020661 | A1 * | 1/2014 | Nishimura | 123/480 |

FOREIGN PATENT DOCUMENTS

| | | | | |
|---|---|---|---|---|
| DE | 60313667 | T2 | 12/2007 | F02D 41/20 |
| DE | 102008040244 | A1 | 1/2010 | F02D 41/00 |
| EP | 1199458 | A2 | 4/2002 | F02D 41/20 |
| WO | 2012/048881 | A1 | 4/2012 | F02D 41/20 |

* cited by examiner

METHOD FOR DETERMINING THE OPENING POINT IN THE TIME OF A FUEL INJECTOR

CROSS-REFERENCE TO RELATED APPLICATIONS

This application is a U.S. National Stage Application of International Application No. PCT/EP2011/005143 filed Oct. 13, 2011, which designates the United States of America, and claims priority to DE Application No. 10 2010 042 467.6 filed Oct. 14, 2010, the contents of which are hereby incorporated by reference in their entirety.

TECHNICAL FIELD

The present disclosure relates to the technical field of controlling indirectly controlled fuel injectors. The present disclosure relates in particular to a method for determining the opening point in time of a control valve of an indirectly controlled fuel injector, which control valve comprises a coil drive. The present disclosure further relates to a corresponding device and a computer program for determining the opening point in time of a control valve of an indirectly controlled fuel injector, which control valve comprises a coil drive.

BACKGROUND

In the case of indirectly controlled fuel injectors, a so-called solenoid actuator controls the valve piston of a control valve and/or a servo valve, by means of which the pressure relationship between a control chamber and a valve chamber are influenced. The movement of the valve needle of the fuel injector is determined by the respective prevailing force relationships that are determined by means of a spring and also the pressures in the control chamber and in the valve chamber. These pressure relationships can be controlled by means of controlling the control valve.

FIG. 5 shows a schematic illustration of an indirectly controlled fuel injector 500 of this type. The fuel injector 500 comprises an outer casing 502 and also an inner casing 504. A displaceably mounted valve needle 510 is located within the inner casing 504 and said valve needle is prestressed by a spring 512. This spring urges the valve needle 510 downwards, so that in a starting state a discharge aperture 514 of the fuel injector 500 is closed.

A control drive 520 is located in an upper part of the fuel injector 500, which upper part is illustrated in a FIG. 5. The control drive 520 comprises a solenoid 522 that is located within an iron yoke 524. The control drive 520 further comprises a piston 530 or rather an armature 530 that is mounted in a displaceable manner and can be moved between a lower contact surface of the iron yoke 524 and a seat 532 of the control valve 520. The piston 530 is mechanically coupled by way of a coupling element 528 to a spring 526. The spring 526 is located within the solenoid 522.

The fuel injector 500 further comprises a control chamber 542 that is connected to a common rail system 550 by way of a high pressure line 540. A pressure sensor 552 is attached to the rail system and the pressure in the rail system can be monitored by means of said pressure sensor by a control unit that is not illustrated. The control chamber 542 is connected to a valve chamber 544 by way of a thin channel not illustrated in FIG. 5. Fuel can flow through this channel at a relatively slow flow rate. The control chamber 542 is moreover connected to a low pressure line 546 (a) by way of a line that is not provided with reference numerals and (b) by way of the control valve 520. The low pressure line is frequently also described as a leakage system 546.

If an injection operation is to be initiated, then the solenoid 522 is energized by means of applying a voltage U_solenoid. The solenoid 522 can be controlled by way of example by controlling the current. The current generates a magnetic force (described in FIG. 5 by F_solenoid) that acts on the piston 530 of the control valve 520. As soon as this magnetic force overcomes the force that is exerted by the spring 526 (described in FIG. 5 by F_spring), which force exerted by said spring fixes the control valve 520 in the non-energized case in the closed position, the piston 530 is moved in an accelerated manner in the direction of the solenoid 522 and/or the lower contact surface of the iron yoke 524. As a consequence, the control valve 520 opens and the highly pressurized fuel can discharge from the control chamber 542 into the low pressure line 546. The resulting pressure difference between the pressure in the 544 valve chamber and the pressure in the control chamber 542 then moves the valve needle 510 of the fuel injector 500 upwards in an accelerated manner and the discharge aperture 514 is opened.

If the injection operation is to be terminated, then the current flow through the solenoid 522 is interrupted. The magnetic force reduces and as soon as the magnetic force is less than the force of the spring 526, the valve piston of the control valve 520 is moved downwards in an accelerated manner into the closed position. The high pressure in the control chamber 542 is built back up and the valve needle 510 of the fuel injector 500 is moved downwards in an accelerated manner into the closed position.

The quantity of fuel to be injected consequently depends directly upon the control of the control valve 520. The dynamic behavior of the control valve 520 is influenced primarily by the opening process and the closing process. Tolerances in the opening behavior and the closing behavior of the control valve 520 lead directly to variations in the quantity of injected fuel.

The opening process is characterized by means of the time it takes for the solenoid 522 and the iron yoke 524 to build up force on the piston 530 and also the resilient force of the spring 526 that counteracts this build-up of force. The build-up of force is on the other hand determined by the geometric dimensions of the actuator (solenoid 522 and iron yoke 524), the electric parameters and/or the magnetic parameters of the solenoid 522 and also fundamentally by the energizing current and/or by the rates of change of the energizing current by means of the solenoid 522.

Different concepts are currently known for controlling (solenoid) fuel injectors. Generally, a difference is established between so-called high voltage concepts and low voltage concepts.

In the case of high voltage concepts, a stabilized voltage (so-called boost voltage in the range between typically 40 volt and 65 volt is provided by way of a costly circuitry in the control device. This voltage is then applied in the so-called boost phase to the fuel injector and guarantees a reproducible and highly dynamic build-up of force at the coil drive and/or solenoid actuator of the control valve of the indirectly controlled fuel injector.

In the case of low voltage concepts, it is only the battery voltage of the corresponding vehicle that is available to control the solenoid actuator. This has the advantage that costly circuitry is not required to generate the boost voltage and consequently considerable cost savings when manufacturing injection systems can be achieved. However, the disadvantage of low voltage concepts resides in the fact that the battery voltage in the vehicle can fluctuate over a relatively wide range of typically 6 volt to 19 volt depending upon operating conditions. This has the result that the build-up of force at the coil drive and/or solenoid actuator is influenced by the prevailing operating voltage. However, the build-up of force at the actuator is the determining variable of the valve dynamics of the control valve. Consequently, the opening behavior of the servo valve and as a consequence also the injection rate depend directly upon the prevailing voltage at the injector.

FIG. 6 illustrates for an indirectly controlled fuel injector:

(a) the progression with respect to time of the voltage that is applied at the coil drive, (b) the progression with respect to time of the coil current that is flowing through the coil drive and (c) the progression with respect to time of the injection rate.

The continuous lines result from measurements in which the available battery voltage amounts to 19 volt.

The broken lines result from measurements in which the available battery voltage amounts to 9 volt.

The quantity of fuel that is injected overall during an injection operation is determined from the integral with respect to time of the injection rate and is consequently significantly dependent upon the injection rate and its progression with respect to time. The point in time in which the injection commences not only influences the injection process but also in particular control ranges it influences the maximum rate that can be achieved during the injection process.

As described above, a quick build-up of force results in the control valve opening quickly and consequently also in the nozzle needle of the indirectly controlled fuel injector opening quickly. A quick build-up of force is facilitated by means of the coil drive of the control valve by virtue of a high (battery) voltage and finally by virtue of a high current strength.

These considerations consequently explain the difference between the two graph progressions that are illustrated in the lower image of FIG. 6. When a higher battery voltage is available, the control valve opens more quickly and the resulting injection operation commences (after a particular hydraulic delay) earlier. As a consequence, when the battery voltage is higher, a higher value is produced for the integral with respect to time of the injection rate and the overall injected quantity of fuel per injection pulse is greater than when a lower battery voltage is available.

SUMMARY

One embodiment provides a method for determining the opening point in time of a control valve of an indirectly controlled fuel injector, in particular of a control valve of an indirectly controlled diesel fuel injector for a combustion engine of a motor vehicle, which control valve comprises a coil drive, the method comprising the steps of: ascertaining the progression with respect to time of the current strength of a current that is flowing through the coil drive, calculating a current integral by way of the ascertained current strength as a function of time commencing at a predetermined starting point in time, and ascertaining a point in time at which the current integral achieves a predetermined current integral reference value, wherein the ascertained point in time is the opening point in time of the control valve.

In a further embodiment, the method further comprises determining the predetermined current integral reference value, wherein the determining process comprises the steps of: detecting the point in time in which the pressure drops in a fuel line, by way of which fuel line fuel is supplied to the fuel injector, and measuring the current integral at the detected point in time, wherein the measured current integral is the predetermined current integral reference value.

In a further embodiment, the predetermined current integral reference value is dependent upon the pressure in the fuel line and wherein the process of determining the predetermining current integral reference value moreover comprises the steps of: measuring the pressure in the fuel line, and storing the measured current integral and the measured pressure in a memory device of an engine control unit of the motor vehicle, wherein the measured current integral for the measured pressure is the pressure-dependent predetermined current integral reference value.

In a further embodiment, the process of determining the predetermined pressure-dependent current integral reference value is performed for different pressures in the fuel line.

In a further embodiment, in order to generate the current that is flowing through the coil drive the coil drive is influenced by a voltage that corresponds to the battery voltage of a battery of the motor vehicle.

Another embodiment provides a method for controlling an indirectly controlled fuel injector in particular for controlling an indirectly controlled diesel fuel injector, for a combustion engine of a motor vehicle, wherein the fuel injector comprises a control valve having a coil drive, the method comprising the steps of: determining the opening point in time of the control valve by implementing the method in accordance with any one of the preceding claims, optimizing a time period for controlling the coil drive on the basis of the determined opening point in time, and controlling the indirectly controlled fuel injector wherein the coil drive is influenced by a voltage pulse, the duration of which is equal to the optimized time period.

Another embodiment provides a device for determining the opening point in time of a control valve of an indirectly controlled fuel injector, in particular of a control valve of an indirectly controlled diesel fuel injector for a combustion engine of a motor vehicle, which control valve comprises a coil drive, the device comprising: a sensing device to ascertain the progression with respect to time of the current strength of a flow that flows through the coil drive, a calculating unit for calculating a current integral by way of the ascertained current strength as a function of time commencing at a predetermined starting point in time, and a comparator unit for ascertaining a point in time in which the current integral achieves at least a predetermined current integral reference value, wherein the ascertained point in time is the opening point in time of the control valve.

Another embodiment provides a computer program for determining the opening point in time of a control valve of an indirectly controlled fuel injector, in particular of a control valve of an indirectly controlled diesel fuel injector, for a combustion engine of a motor vehicle, which control valve comprises a coil drive, wherein the computer program is designed, when performed by a processor, to control any of the methods disclosed above.

BRIEF DESCRIPTION OF THE DRAWINGS

Example embodiments are discussed below with reference to the drawings, in which.

DETAILED DESCRIPTION

Figure 1:
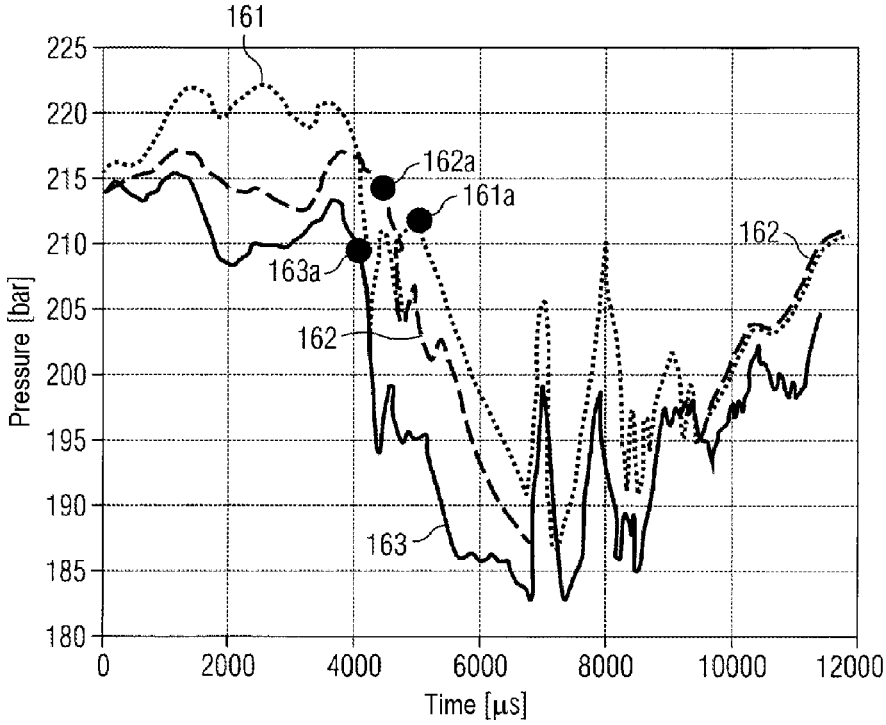
FIG. 1 shows the progression of pressure in the fuel supply line for an indirectly controlled fuel injector.

Embodiments of the present invention may improve the accuracy of the quantities injected by indirectly controlled fuel injectors.

In some embodiments, a method is described for determining the opening point in time of a control valve of an indirectly controlled fuel injector for a combustion engine of a motor vehicle, which control valve comprises a coil drive. The fuel injector is in particular an indirectly controlled diesel fuel injector. The method described comprises:

(a) Ascertain the progression with respect to time of the current strength of a current flowing through the coil drive, (b) Calculate a current integral by way of the ascertained current strength as a function of time commencing at a predetermined starting point in time, and (c) Ascertain a point in time at which the current integral achieves at least a predetermined current integral reference value, wherein the ascertained point in time is the opening point in time of the control valve.

The method described for determining the opening point in time is based on the knowledge that there is a direct correlation between the opening point in time of the control valve, which can be detected for example by virtue of a pressure drop in a fuel line for the indirectly controlled fuel injection, and the current integral as a purely electrical operating variable of the control valve. It has namely been established that, irrespective of the boundary conditions, for example the temperature or a leakage counter pressure that is prevailing at the indirectly controlled fuel injector, the control valve of the indirectly controlled fuel injector then opens in a good approximation precisely when the current integral, which is determined as a function of time, achieves a particular reference value by way of the current that is flowing through the coil drive. Since the progression with respect to time and in particular the value of the current integral is also dependent upon the voltage, with which the current is supplied to the coil drive, the understood existing dependence of the opening point in time of the control valve on this voltage is taken into consideration by virtue of the dependence in of the opening point in time on the current integral.

The predetermined starting point in time is within a time window prior to the commencement of the control valve being influenced by the current and/or the voltage that is causing the current. Since the control and in particular the progression with respect to time of the control of the control valve in an engine control unit of the motor vehicle is known precisely, the predetermined starting point in time can be selected in a simple manner, so that on the one hand it is in good time prior to the commencement of the control of the control valve and on the other hand not too long prior to the commencement of this control process, so that, any possibly occurring and possibly disturbing fluctuations whilst ascertaining the progression with respect to time of the current strength are not of excessive significance.

In other words, the increase in the current integral as a function of time is monitored. As soon as the current integral achieves the mentioned reference value, it is assumed that the control valve of the indirectly controlled fuel injector opens. By virtue of the described application of the current integral, the opening point in time of the control valve can be ascertained with a high level of accuracy irrespective of other measurement variables, for example a pressure measurement, a temperature measurement etc., and uninfluenced by other operating conditions such as for example a possibly currently prevailing activity of a fuel pump and/or a prevailing fuel injection process by means of another fuel injector that is connected to the same fuel line.

The reference value that is used can be ascertained within the scope of test injection processes for example using engine test equipment that is provided especially for this purpose. It is preferred that the reference value is ascertained during stable operating conditions, for example at a voltage of 14 volt and without any pressure fluctuations in a fuel line that is supplying the fuel injector with fuel.

Reference is made to the fact that the described method can naturally also be implemented by means of digitally processing measurement data. In this case, the current integral is formed by summating different digital measurement values that correspond to the current strength that is determined at a specific point in time.

In accordance with a further embodiment, the method further comprises the step of calculating the predetermined current integral reference value. The process of calculating this predetermined current integral reference value comprises the steps of:

(a) Detecting the point in time in which the pressure drops in a fuel line, by way of which fuel line fuel is supplied to the fuel injector, and (b) Measuring the current integral at the detected point in time, wherein the measured current integral is the predetermined current integral reference value.

As already mentioned above, the described drop in pressure causes the control valve to open. Consequently, the point in time in which the pressure drops corresponds to the point in time in which the control valve actually opens. The measured current integral is consequently the quantity of current (in the unit ampere-seconds) that is flowing through the coil drive and has accumulated from the point of the predetermined starting point in time until the point in time in which the pressure drops.

Reference is made to the fact that the particular opening point in time of the control valve, which opening time is determined hydraulically on the basis of the pressure drop, can also be used in conjunction with the calculation of the current integral for regular calibration processes, wherein under particular boundary conditions test control processes for generating only a switch leakage of the injection valve and not yet for generating an actual injection process are implemented and consequently the value of the current integral is calculated at the opening point in time. This particular and if necessary up-dated value is then used to detect the opening of the control valve during the further progression of the drive cycle (or beyond). This can then also occur during operating conditions under which this would not be possible using the one pressure signal.

In accordance with a further embodiment, the predetermined current integral reference value is dependent upon the pressure in the fuel line. Furthermore, the step of calculating the predetermined current integral reference value further comprises:

(a) Measuring the pressure in the fuel line, and (b) Storing the measured current integral and the measured pressure in a memory device of an engine control unit of the motor vehicle, wherein the measured current integral for the measuring pressure is the pressure-dependent predetermined current integral reference value.

The opening point in time of the control valve can be ascertained in a particularly precise manner by taking into consideration the fuel pressure that prevails at the time of calculating the current integral reference value.

The described process of calculating the current integral reference value may be implemented in the case of a fixed and preferably particularly stable nominal voltage and/or reference voltage. The nominal voltage and/or reference voltage is again the voltage with which the coil drive is influenced in order to provide the current necessary for activating the control valve.

A dependence of the opening behavior and in particular of the actual opening point in time upon the pressure of the fuel that is to be injected can be attributed to the fact that the control valve is not perfectly pressure-adjusted because for example the geometry of the control valve changes in dependence upon the pressure of the fuel. In particular, any increase in the fuel pressure can cause a widening of the valve seat, even if only slight, for example of a few micrometers.

In accordance with a further embodiment, the process of calculating the predetermined pressure-dependent current integral reference value is performed for different pressures in the fuel line. In other words, the aforementioned method for calculating the (pressure-dependent) predetermined current integral reference value is performed for different pressures. In this manner, a corresponding current integral reference value is stored in the memory device of the engine control unit for each measured pressure and said current integral reference value is then used in the case of the above described process of determining the opening point in time of the control valve.

In other words, the integral of the current flowing through the coil drive is ascertained during the operation with the reference voltage and/or the nominal voltage at the actual opening point in time, which opening point is detected by virtue of a temporary interruption of the pressure in the fuel line (rail pressure).

This current integral value that is dependent upon the rail pressure can be used hereinunder as the current integral reference value ($\int I dt_{ref}$) in order to recognize the opening of the control valve if the corresponding indirectly controlled fuel injector is operated at other voltages that are prevailing at the coil drive. The corresponding opening time in the case of this reference voltage can be used, as is explained in more detail hereinunder, as the reference opening point in time $t_0$ in order to determine a correction value for controlling the control valve within the scope of subsequent injection operations.

In accordance with a further embodiment, the coil drive is influenced by a voltage in order to generate the current that is flowing through the coil drive, said voltage corresponds to the battery voltage of a battery of the motor vehicle. This means that the described method is used within the scope of a so-called low voltage concept for controlling the coil drive of the indirectly controlled fuel injector. A relatively costly process of increasing the voltage for the purpose of controlling the control valve particularly quickly is omitted. The reason being that when using a low voltage concept, fluctuations in the battery voltage can cause significant variations in the opening point of time and such variations in the opening point in time can be determined by means of the described method and compensated for during subsequent injection operations by virtue of performing a corresponding different control process, the described method can be particularly helpful in the case of low voltage concepts of this type in order to achieve an optimized control of the indirectly controlled fuel injectors.

Other embodiments provide a method for controlling an indirectly controlled fuel injector for a combustion engine of a motor vehicle, wherein the fuel injector comprises control valve having a coil drive.

The described control method comprises the steps of:

(a) Determining the opening point in time of the control valve by implementing the above described method in order to determine the opening point in time of a control valve of an indirectly controlled fuel injector, which control valve comprises a coil drive, (b) Optimizing a time period for controlling the coil drive on the basis of the determined opening point in time, and (c) Controlling the indirectly controlled fuel injector, wherein the coil drive is influenced by a voltage pulse, the duration of which is equal to the optimized time period.

The described control method is based on the knowledge that it is possible, based on the knowledge of the actual opening point in time of the control valve, to determine the time variation of this actual opening point in time relative to a reference opening point in time $t_0$. In order to adapt and optimize the activation time for subsequent injection operations, this time variation can be added to the previous activation time or subtracted therefrom depending upon the algebraic sign. Consequently, a change to the duration of the effective control of the control valve can be compensated for and the actual duration of the injection operation of the indirectly controlled fuel injection can be optimized, said change being caused by a variation in the opening point of time (in particular as a result of a changed control voltage for the coil drive).

Reference is made in this connection to the fact that the actual commencement of the injection process of an indirectly controlled fuel injector in comparison to the opening of the control valve typically occurs with a particular hydraulic delay. This hydraulic delay that can be measured precisely for example using an engine test bench is in a good approximation dependent upon the voltage that is applied to the coil drive. However, this hydraulic delay is also dependent upon the pressure of the fuel that is available at the fuel injector and the level of this dependence can be determined likewise within the scope of test and/or calibration procedures, for example using an engine test bench.

It is possible during the actual operation of the engine then to use the information regarding the fuel pressure, which is provided in a known manner by a pressure sensor in the fuel line, for the purpose of also taking into consideration the currently occurring hydraulic delay as the control valve and/or the coil drive of the control valve is activated.

Other embodiments provide a device for determining the opening point in time of a control valve of an indirectly controlled fuel injector for a combustion engine of a motor vehicle, which control valve comprises a coil drive. The device described comprises:

(a) a sensing device to ascertain the progression with respect to time of the current strength of a flow that flows through the coil drive, (b) a calculating unit for calculating a current integral by way of the ascertained current strength as a function of time commencing at a predetermined starting point in time, and (c) a comparator unit for ascertaining a point in time in which the current integral achieves at least a predetermined current integral reference value, wherein the ascertained point in time is the opening point in time of the control valve.

The device described is also based on the knowledge that the opening point in time of the control valve of an indirectly controlled fuel injector can be detected by means of calculating the current integral that continuously increases with the commencement of the current flow through the drive. The opening point in time of the control valve is the point in time in which this current integral as a function of time achieves a particular reference value.

At least some of the mentioned units of the device and in particular all these units can be achieved by means of a microprocessor. The microprocessor can be part of an engine control unit for a combustion engine of a motor vehicle.

In accordance with a further embodiment, a computer program is described for determining the opening point in time of a control valve of an indirectly controlled fuel injector for a combustion engine of a motor vehicle, which control valve comprises a coil drive. The computer program is designed, when performed by a processor, to control the above described method for determining the opening point in time of a control valve of an indirectly controlled fuel injector, which control valve comprises a coil drive.

In terms of this document, the naming of a computer program of this type equates to the term of a program element, a computer program product and/or a computer-readable medium, that contains instructions to control a computer system, in order to coordinate the operating procedure of a system and/or a method in an appropriate manner in order to achieve associated effects using the disclosed method.

The computer program can be implemented as a computer readable instruction code in any suitable programming language such as in JAVA, C++ etc. The computer program can be stored on a computer-readable memory medium (CD-rom, DVD, Blu-ray disk, removable disk drive, volatile or non-volatile memory device, integrated memory device/processor etc.). The instruction code can program a computer or other programmable devices such as in particular a control device for an engine of a motor vehicle in such a manner that the desired functions are implemented. Furthermore, the computer program can be available on a network for example on the internet, from where it can be downloaded as required by a user.

Various embodiments can be achieved both by means of a computer program, i.e. software, and by means of one or more special electrical circuits, i.e. in hardware or in any user-defined hybrid form, i.e. by means of software components and hardware components.

Reference is made to the fact that various embodiments have been described with reference to different subject matters of the invention. In particular, some embodiments of the invention are described by method claims and other embodiments of the invention are described by device claims. However, it will be immediately clear to the person skilled in the art when reading this application that, unless explicitly otherwise mentioned, in addition to a combination of features that belong to a type of subject matter of the invention, any user-defined combination of features that belong to different types of subject matters of the invention is also possible.

FIG. 1 shows the progression with respect to time of pressure in the fuel supply line for an indirectly controlled fuel injector for different battery voltages that are used within the scope of a low voltage concept for controlling the coil of the control valve of the indirectly controlled fuel injector. The points in time at which the control valve of the indirectly controlled fuel injector opens are determined in each case from a significant drop in pressure and are characterized in FIG. 1 by in each case a filled circle. The dotted line 161 represents the progression of pressure in the case of a first battery voltage U1. The corresponding opening point in time is characterized by the reference numeral 161*a*. The broken line 162 illustrates the progress of pressure in the case of a second battery voltage U2 that is greater than the first battery voltage U1. The corresponding opening point in time is characterized by the reference numeral 162*a*. The continuous line 163 represents the progression of pressure in the case of a third battery voltage U3 that is greater than the second battery voltage U2.

The corresponding opening point in time is characterized by the reference numeral 163*a*. It is evident from FIG. 1 that the opening point in time of the control valve of the indirectly controlled fuel injector depends upon the available battery voltage.

Figure 2:
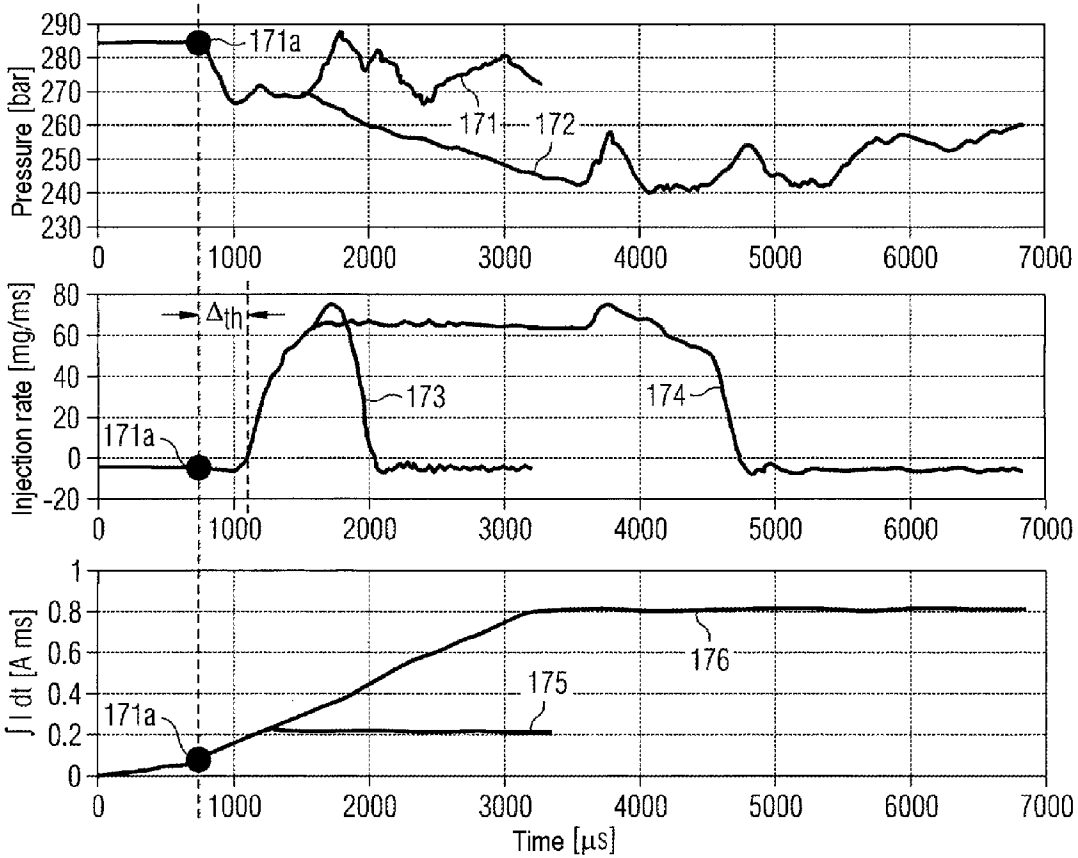
FIG. 2 shows graphs for an indirectly controlled fuel injector for in each case two periods of electrical control that are of different durations: (a) the progression with respect to time of the pressure in the fuel supply line, (b) the progression with respect to time of the injection rate, and (c) the progression with respect to time of the current integral.

FIG. 2 shows for an indirectly controlled fuel injector for in each case two periods of electrical control ti of the control valve that are of different durations:

(a) the progression with respect to time of the pressure in the fuel supply line (upper diagram), (b) the progression with respect to time of the injection rate (middle diagram), and (c) the progression with respect to time of the current integral (lower diagram).

The line that is provided with the reference numeral 171 represents the progression of pressure in the case of a first relatively short period of control of the control valve. The line provided with the reference number 172 represents the progression of pressure in the case of a second period of control that is relatively long in comparison to the first period of control. The opening point in time of the control valve that is illustrated in all the diagrams by a filled-in circle 171*a* is determined from these progressions of pressure. The graph 173 in the middle diagram represents the progression of the injection rate in the case of the first period of control, the graph 174 represents the progression of the injection rate in the case of the second period of control 174. As is evident from this diagram, the actual commencement of the injection process follows the opening point in time 171*a* at a particular delay with respect to time and this is described as a so-called hydraulic delay $\Delta t_h$.

The graph 175 in the lower diagram represents the current integral $\int I dt$ in the case of the first period of control. The graph 176 represents the current integral $\int I dt$ that achieves a considerably higher value as a result of the longer period of electrical control ti in the case of the second period of control. In so far as the control valve of the indirectly controlled fuel injector actually opens, this opening point in time 171*a* does not depend in a good approximation upon the duration period of the electrical control of the servo valve.

It is further evident from the behavior illustrated in FIG. 2 for the respective current integral $\int I dt$ that the opening point in time of the control valve depends upon the current integral $\int I dt$. This means that during the operation of the fuel injector with a reference voltage and/or nominal voltage, the opening point in time (that can be detected by an interruption of the pressure in the fuel line) is determined by means of the integral with respect to time of the progression of the current through the coil drive of the control valve. This pressure-dependent value of the integral $\int Idt$ can then be used as a reference value $\int Idt_{ref}$ in the case of other available battery voltages in order to recognize the opening of the servo valve. A corresponding opening time in the case of this reference voltage and/or nominal voltage can then be used as a reference opening point in time and/or as the reference time $t_0$ for determining a correction value for the electrical control of the control valve within the scope of the subsequent injection operations.

Figure 3:
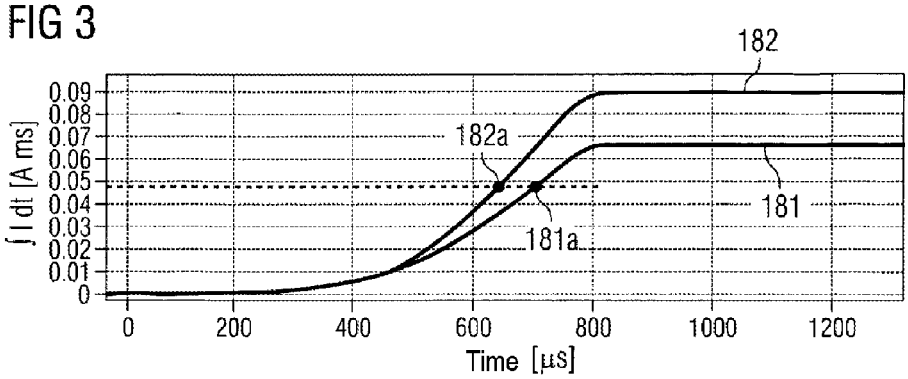
FIG. 3 shows for two different operating voltages the progression with respect to time of the integrated current through the coil drive.

FIG. 3 shows for two different operating voltages the progression with respect to time of the current integral $\int Idt$ through the coil drive of the control valve. The line provided with the reference numeral 181 represents the current integral $\int Idt$ in the case of a first battery voltage that amounts to 9 volt in accordance with the exemplary embodiment 9 illustrated here. The corresponding opening point in time that is characterized by the reference numeral 181*a* is somewhat higher than 700 μs. The line that is provided with the reference numeral 182 represents the current integral $\int Idt$ in the case of a second battery voltage that amounts to 19 volt in the case of the exemplary embodiment illustrated here. The corresponding opening point in time that is characterized by the reference numeral 182*a* is somewhat higher than 600 μs.

It is evident from FIG. 3 that two opening points in time 181*a* and 182*a* occur depending upon the voltage with a high level of accuracy precisely at the time as soon as a current integral reference value $\int Idt_{ref}$ is achieved. In accordance with the exemplary embodiment illustrated here, this current integral reference value $\int Idt_{ref}$ is just below 0.05 A ms ($=5\times10^{-5}$ As).

Figure 4A:
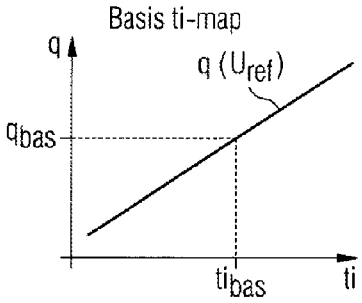
FIGS. 4*a*-4*c* illustrate an adaptation of the duration of the control of a control valve of an indirectly controlled fuel injector based on determining the actual opening point in time of the control valve.
Figure 4B:
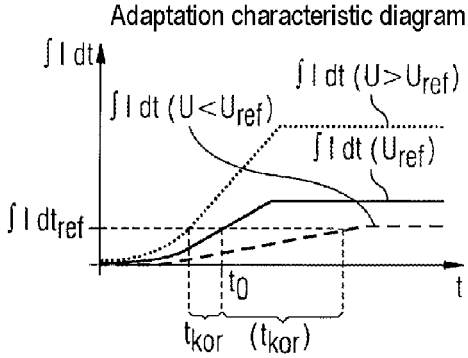
Figure 4C:
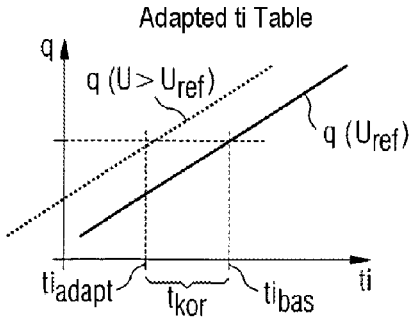
Figure 5:
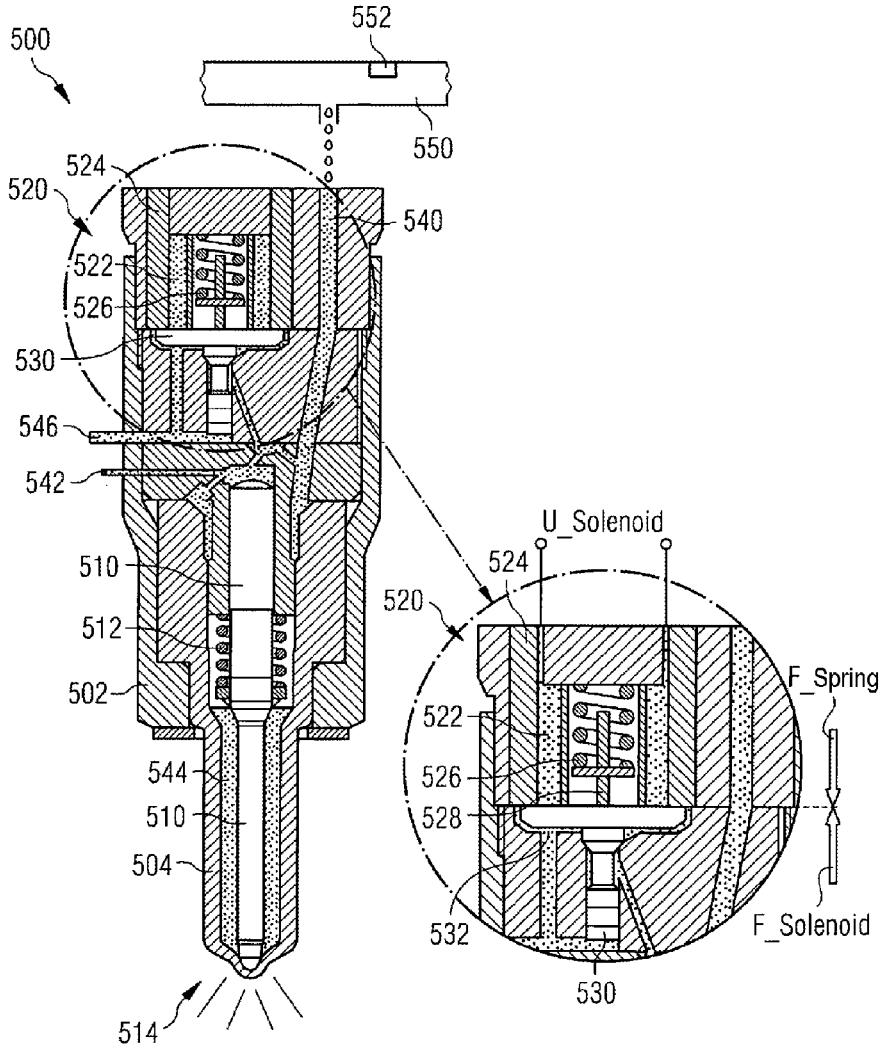
FIG 5 (Prior Art)
FIG. 5 shows a schematic illustration of an indirectly controlled fuel injector known from the prior art.
Figure 6:
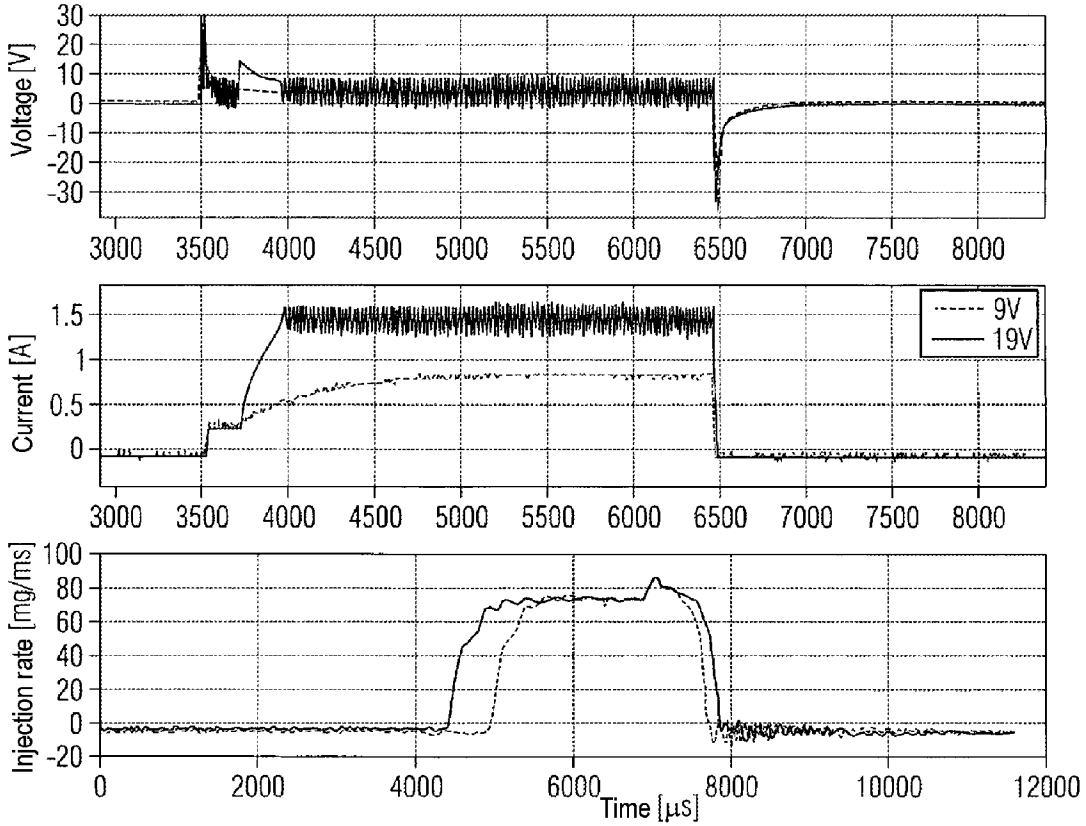
FIG 6 (Prior Art)
FIG. 6 shows for an indirectly controlled fuel injector: (a) the progression with respect to time of the voltage that is prevailing at the coil drive, (b) the progression with respect to time of the coil current that is flowing through the coil drive, and (c) the progression with respect to time of the injection rate.

The FIGS. 4*a* to *c* illustrate an adaptation of the duration of the control of a control valve of an indirectly controlled fuel injector based on determining the actual opening point in time of the control valve.

FIG. 4*a* shows in the case of a reference voltage and/or nominal voltage $U_{ref}$ the relationship between a desired quantity of fuel to be injected q per injection pulse (predetermined for example by the driver's request or rather by the position of a gas pedal) and the duration ti of the electrical control of the control valve of an indirectly controlled fuel injector. A particular electrical control period $ti_{bas}$ is provided for a desired quantity of fuel to be injected $q_{bas}$. The graph illustrated in FIG. 4*a* is stored in an engine control unit typically in a so-called basis ti table. This basis ti table comprises in each case for different fuel pressures pairs of different values consisting of a quantity of fuel to be injected q and the associated control period ti. FIG. 4*a* illustrates for a particular pressure a section from a basis ti table of this type.

In accordance with an exemplary embodiment illustrated here, an adapted ti table is determined during the vehicle operation and consequently in the case of fluctuating battery voltages based on the basis ti table by way of an adaptation characteristic diagram. This adaptation is described hereinunder with reference to the FIGS. 4*b* and 4*c*.

A calibrating process is initially performed in a calibrating mode, wherein the corresponding adaptation values are generated with the aid of test pulses in the case of the reference voltage. For this purpose, in a time window in which the fuel pressure in the fuel line is stable (no pump supply or injection), test pulses are performed in order to generate only a switch leakage in the indirectly controlled fuel injection.

The value of the current integral at which the fuel pressure begins to break down and the corresponding time for this after the commencement of the control are stored as reference values ($\int Idt_{ref}$ and $t_0$) in the adaptation characteristic diagram (cf. FIG. 4*b*). Since the reference value and the reference time are pressure-dependent, this occurs for a series of different fuel pressures.

Outside the calibrating mode, the corresponding current is integrated in the case of possibly fluctuating battery voltages during each control process of the control valve. As soon as this integral fIdt achieves the reference value $\int Idt_{ref}$, the corresponding opening point in time is determined. This is illustrated in FIG. 4*b* for a voltage that is greater than the reference voltage (dotted line) and for a voltage that is smaller than the reference voltage (broken line). The corresponding deviation $t_{kor}$ of this time from the reference time $t_0$ is then used to correct the effective duration of the control process.

FIG. 4*c* illustrates the corresponding adapted ti table for the above mentioned voltage that is greater than the reference voltage. In the present case, based on $ti_{bas}$ the duration of the electrical control ti is shorted to an adapted duration of electrical control $t_{adapt}$.

Consequently, the described method determines an injector individual reference value $\int Idt_{ref}$ and an injector individual reference control time $t_0$ based on an interruption of the reference pressure break down in the fuel line of an indirectly controlled fuel injector in the case of a nominal battery voltage (e.g. 14 volt). Furthermore, an injector opening point in time correction ($t_{kor}$) that is dependent upon the currently available battery voltage is determined by way of an adaptation characteristic diagram. The injector individual opening behavior of the corresponding control valve can be corrected in a simple manner using the following equation:

$$ti_{adapt}=ti_{bas}+ti_{kor}$$

The described method has inter alia the advantage that no additional sensors for recognizing changes in the quantities of fuel to be injected are required to implement said method.

LIST OF REFERENCE NUMERALS

161 Progression of pressure in the case of a first battery voltage U1
161*a* Opening point in time of the control valve in the case of a first battery voltage U1
162 Progression of pressure in the case of a second battery voltage U2 (U2>U1)
162*a* Opening point in time of the control valve in the case of the second battery voltage U2
163 Progression of pressure in the case of a third battery voltage U3 (U3>U2)
163*a* Opening point in time of the control valve in the case of a third battery voltage U3
171 Progression of pressure in the case of a first period of control
171*a* Opening point in time of the control valve
172 Progression of pressure in the case of a second period of control that is longer than the first period of control
173 Progression of the injection rate in the case of the first period of control
174 Progression of the injection rate in the case of the second period of control
175 Current integral in the case of the first period of control
176 Current integral in the case of the second period of control
181 Current integral in the case of a low battery voltage (9 V)
181*a* Opening point in time of the control valve in the case of a low battery voltage (9 V)
182 Current integral in the case of a high battery voltage (19 V)

182*a* Opening point in time of the control valve in the case of a high battery voltage (19 V)
500 Indirectly controlled fuel injector
502 Outer casing
504 Inner casing
510 Valve needle
512 Spring
514 Discharge aperture
520 Control drive/Control valve
522 Coil/Solenoid
524 Iron yoke
526 Spring
528 Coupling element
530 Piston/Armature of the control valve
532 Seat of the control valve
540 High pressure line
542 Control chamber
544 Valve chamber
546 Low pressure line/Leakage system
550 Common rail system
552 Sensor for rail pressure

What is claimed is:

1. A method for determining an opening point in time of a control valve of an indirectly controlled diesel fuel injector of a combustion engine of a motor vehicle, which control valve comprises a coil drive, the method comprising:
determining a progression with respect to time of a current strength of a current flowing through the coil drive,
calculating a current integral based on the determined current strength as a function of time commencing at a predetermined starting time, and
determining a point in time at which the current integral achieves a predetermined current integral reference value, wherein the determined point in time is the opening point in time of the control valve.

2. The method of claim 1, further comprising determining the predetermined current integral reference value, which comprises:
detecting a point in time at which a pressure drops in a fuel line configured to supply fuel to the fuel injector, and
measuring the current integral at the detected point in time, wherein the measured current integral is the predetermined current integral reference value.

3. The method of claim 2, wherein the predetermined current integral reference value is dependent upon the pressure in the fuel line, and wherein the process of determining the predetermining current integral reference value moreover comprises steps of:
measuring the pressure in the fuel line, and
storing the measured current integral and the measured pressure in a memory device of an engine control unit of the motor vehicle, wherein the measured current integral for the measured pressure is the pressure-dependent predetermined current integral reference value.

4. The method of claim 3, comprising performing the process of determining the predetermined pressure-dependent current integral reference value for different pressures in the fuel line.

5. The method of claim 1, comprising influencing the coil drive by a voltage corresponding to the battery voltage of a battery of the motor vehicle, in order to generate the current flowing through the coil drive.

6. A method for controlling an indirectly controlled diesel fuel injector of a combustion engine of a motor vehicle, wherein the fuel injector comprises a control valve having a coil drive, the method comprising:
determining an opening point in time of the control valve:
determining a progression with respect to time of a current strength of a current flowing through the coil drive,
calculating a current integral based on the determined current strength as a function of time commencing at a predetermined starting time, and
determining a point in time at which the current integral achieves a predetermined current integral reference value, wherein the determined point in time is the opening point in time of the control valve,
optimizing a time period for controlling the coil drive based on the determined opening point in time, and
controlling the indirectly controlled fuel injector wherein by influencing the coil drive with a voltage pulse having a duration equal to the optimized time period.

7. A device for determining an opening point in time of a control valve of an indirectly controlled diesel fuel injector of a combustion engine of a motor vehicle, which control valve comprises a coil drive, the device comprising:
a sensing device configured to determine the progression with respect to time of a current strength of a flow that flows through the coil drive,
a calculating unit configured to calculate a current integral based on the determined current strength as a function of time commencing at a predetermined starting time, and
a comparator unit configured to determine a point in time at which the current integral achieves at least a predetermined current integral reference value, wherein the determined point in time is the opening point in time of the control valve.

8. The device of claim 7, further configured to:
detecting a point in time at which a pressure drops in a fuel line configured to supply fuel to the fuel injector, and
measuring the current integral at the detected point in time, wherein the measured current integral is the predetermined current integral reference value.

9. The device of claim 8, wherein the predetermined current integral reference value is dependent upon the pressure in the fuel line, and wherein the process of determining the predetermining current integral reference value moreover comprises:
measuring the pressure in the fuel line, and
storing the measured current integral and the measured pressure in a memory device of an engine control unit of the motor vehicle, wherein the measured current integral for the measured pressure is the pressure-dependent predetermined current integral reference value.

10. The device of claim 9, configured to perform the process of determining the predetermined pressure-dependent current integral reference value for different pressures in the fuel line.

11. The device of claim 7, further configured to influence the coil drive by a voltage corresponding to the battery voltage of a battery of the motor vehicle, in order to generate the current flowing through the coil drive.

12. A computer program for determining the opening point in time of a control valve of an indirectly controlled diesel fuel injector of a combustion engine of a motor vehicle, which control valve comprises a coil drive, wherein the computer program comprises computer-readable instructions stored in non-transitory media and executable by a processor to:
determine a progression with respect to time of a current strength of a current flowing through the coil drive,
calculate a current integral based on the determined current strength as a function of time commencing at a predetermined starting time, and
determine a point in time at which the current integral achieves a predetermined current integral reference value, wherein the determined point in time is the opening point in time of the control valve.

13. The computer program of claim 12, further comprising instructions for determining the predetermined current integral reference value by:

detecting a point in time at which a pressure drops in a fuel line configured to supply fuel to the fuel injector, and measuring the current integral at the detected point in time, wherein the measured current integral is the predetermined current integral reference value.

14. The computer program of claim 13, wherein the predetermined current integral reference value is dependent upon the pressure in the fuel line, and wherein determining the predetermining current integral reference value moreover comprises:

measuring the pressure in the fuel line, and storing the measured current integral and the measured pressure in a memory device of an engine control unit of the motor vehicle, wherein the measured current integral for the measured pressure is the pressure-dependent predetermined current integral reference value.

15. The computer program of claim 14, comprising instructions for performing the process of determining the predetermined pressure-dependent current integral reference value for different pressures in the fuel line.

16. The computer program of claim 12, further comprising instructions for influencing the coil drive by a voltage corresponding to the battery voltage of a battery of the motor vehicle, in order to generate the current flowing through the coil drive.

* * * * *